US009828141B2

(12) United States Patent
Brufsky

(10) Patent No.: US 9,828,141 B2
(45) **Date of Patent: *Nov. 28, 2017**

(54) INTEGRATED ENVELOPE ASSEMBLY INCLUDING ORIGINAL AND RETURN ENVELOPE COMPONENTS

(71) Applicant: Alexander I. Brufsky, Upper St. Clair, PA (US)

(72) Inventor: Alexander I. Brufsky, Upper St. Clair, PA (US)

( * ) Notice: Subject to any disclaimer, the term of this patent is extended or adjusted under 35 U.S.C. 154(b) by 233 days.

This patent is subject to a terminal disclaimer.

(21) Appl. No.: 14/270,645

(22) Filed: May 6, 2014

(65) Prior Publication Data

US 2014/0239055 A1 Aug. 28, 2014

Related U.S. Application Data

(62) Division of application No. 12/908,952, filed on Oct. 21, 2010, now Pat. No. 8,752,756.

(51) Int. Cl.
*B65D 27/06* (2006.01)
*B65D 27/14* (2006.01)

(52) U.S. Cl.
CPC ..... *B65D 27/06* (2013.01); *B65D 27/14* (2013.01)

(58) Field of Classification Search
CPC ..... B65D 27/00; B65D 27/06; B65D 27/14; B65D 27/32; B65D 27/34; B65D 27/36; B65D 27/38; Y02W 30/807; B42D 15/08
USPC ..... 229/300–315
See application file for complete search history.

(56) References Cited

U.S. PATENT DOCUMENTS

| | | | | | |
|---|---|---|---|---|---|
| 2,088,068 | A | * | 7/1937 | Overbaugh, Jr. | 229/83 |
| 3,059,291 | A | * | 10/1962 | Sherwood | 49/371 |
| 3,139,231 | A | * | 6/1964 | Hueschen | 206/459.5 |
| 3,184,150 | A | * | 5/1965 | Hubbard | 229/305 |
| 3,652,007 | A | * | 3/1972 | MacDougall | 229/304 |
| 4,334,618 | A | * | 6/1982 | Buescher | 229/314 |
| 4,379,573 | A | * | 4/1983 | Lomeli et al. | 428/42.3 |
| 4,586,611 | A | * | 5/1986 | Scalzo | 229/316 |
| 4,640,030 | A | * | 2/1987 | Wood et al. | 40/746 |
| 4,770,337 | A | * | 9/1988 | Leibe | 229/69 |
| 5,071,167 | A | * | 12/1991 | O'Brien | 283/79 |
| 5,209,698 | A | * | 5/1993 | Dolan | 462/17 |
| 5,324,927 | A | * | 6/1994 | Williams | 235/494 |

(Continued)

*Primary Examiner* — Peter Helvey
(74) *Attorney, Agent, or Firm* — Eckert Seamans Cherin & Mellott, LLC; Philip E. Levy

(57) ABSTRACT

An envelope assembly includes an original and a return address components. The original address component has a front side having an original address provided thereon, a rear side, and a first attachment portion provided around at least part of the perimeter of the original address component. The return address component includes a second attachment portion provided around at least part of the perimeter of the return address component and a return envelope portion, wherein the second attachment portion is attached to the first attachment portion The return envelope portion has a front side having a return address provided thereon, a rear side, and an interior for receiving return mailing materials. The rear side of the original address component faces the front side of the return envelope portion, and the return envelope portion is removeably attached to and separable from the second attachment portion by a first separation device.

1 Claim, 14 Drawing Sheets

(56) References Cited

U.S. PATENT DOCUMENTS

| | | | | |
|---|---|---|---|---|
| 5,967,403 | A * | 10/1999 | Kranz | 229/70 |
| 6,237,844 | B1 * | 5/2001 | Purcell | 229/313 |
| 6,254,138 | B1 * | 7/2001 | Rawlings et al. | 283/81 |
| 7,815,099 | B2 | 10/2010 | DeLaVergne | |
| 8,322,597 | B2 * | 12/2012 | Purcell et al. | 229/70 |
| 2004/0050918 | A1 * | 3/2004 | DeLaVergne | 229/305 |
| 2005/0184140 | A1 * | 8/2005 | DeLa Vergne | 229/301 |
| 2006/0219769 | A1 * | 10/2006 | DeLaVergne | 229/301 |
| 2006/0266808 | A1 * | 11/2006 | DeLaVergne | 229/72 |
| 2009/0302099 | A1 | 12/2009 | DeLaVergne | |
| 2013/0026216 | A1 * | 1/2013 | Brown | 229/303 |

* cited by examiner

INTEGRATED ENVELOPE ASSEMBLY INCLUDING ORIGINAL AND RETURN ENVELOPE COMPONENTS

CROSS REFERENCE TO RELATED APPLICATIONS

This is a Divisional Application which claims the benefit of U.S. patent application Ser. No. 12/908,952 filed Oct. 21, 2010, which is incorporated by reference herein.

BACKGROUND OF THE INVENTION

1. Field of the Invention

The present invention relates to mailing envelopes, and, in particular, to an integrated envelope assembly that includes an original envelope component and a return envelope component for facilitating mailings wherein the original recipient is expected to provide a return mailing to the original sender.

2. Description of the Related Art

Envelopes have long been used to contain and send materials from a sender to a recipient through the mail. In a number of circumstances, it is necessary for the original recipient to send materials back to the original sender by mail. For example, a business may send a bill to a customer in an original envelope and require that a payment be sent back to the business by mail. As another example, a survey may be mailed to an individual with the expectation that completed survey materials will be returned by mail. As still another example, promotional materials for a product or service may be mailed to an individual along with an order form that may be completed and returned if the individual desires to purchase the goods or services in question.

In such circumstances, it is common practice to enclose a pre-addressed (and sometimes pre-posted) return envelope in the original envelope along with the original mailing materials. In practice, the intended recipient opens the original mailing, prepares the return mailing materials (e.g., completes a form, or makes out a check, or the like), and places the return mailing materials in the return envelope included as part of the original mailing. The return envelope is then deposited in the mail.

While this system has proven to be effective for a number of applications, there is room for improvement in the area of mailings wherein the original recipient is expected to provide a return mailing to the original sender.

SUMMARY OF THE INVENTION

In one embodiment, an envelope assembly is provided that includes an original address component and a return address component. The original address component has a front side having an original destination address provided thereon, a rear side opposite the front side of the original address component, and a first attachment portion provided around a perimeter of the original address component. The return address component includes a second attachment portion provided around a perimeter of the return address component and a return envelope portion, wherein the second attachment portion of the return address component is attached to the first attachment portion of the original address component. The return envelope portion has a front side having a return address provided thereon, a rear side opposite the front side of the return envelope portion, and a first interior for receiving return mailing materials. The rear side of the original address component faces the front side of the return envelope portion, and the return envelope portion is removeably attached to and selectively separable from the second attachment portion by a first separation device. The front side of the return envelope portion may also have return postage provided thereon. Also, the return envelope portion is preferably sealed around the outer perimeter of the return envelope portion.

In one particular embodiment, the first separation device comprises a perforation extending around the outer perimeter of the return envelope portion and a string provided beneath the perforation for separating the perforation, the string having a pull tab attached thereto. The envelope assembly may further include a second separation device provided on the rear side of the return envelope portion, the second separation device being structured to selectively separate a first portion of the rear side of the return envelope portion from a second portion of the rear side of the return envelope portion and provide access to the second interior, the second portion of the rear side of the return envelope portion forming a flap for the return envelope portion. The second separation device may include a second perforation extending in a V-shape and a second string provided beneath the second perforation for separating the second perforation, the string having a second pull tab attached thereto.

In another embodiment, an envelope assembly is provided that includes an original envelope component having a rear side having an original destination address provided thereon, a front side opposite the rear side of the original envelope component, a first interior for receiving original mailing materials, and a flap attached to the rear side of the original envelope component, and a return envelope component including an attachment portion provided around at least a portion of a perimeter of the return envelope component and a return envelope portion. The attachment portion is attached to the first side of the original envelope component, and the return envelope portion has a rear side having a return address provided thereon, a front side opposite the rear side of the return envelope portion, and a second interior for receiving return mailing materials. The flap is structured to fold down over and be removeably attached to the front side of the return envelope portion by a first separation device, and the return envelope portion is removeably attached to and selectively separable from the attachment portion by a second separation device.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE EXEMPLARY EMBODIMENTS

Figure 1:
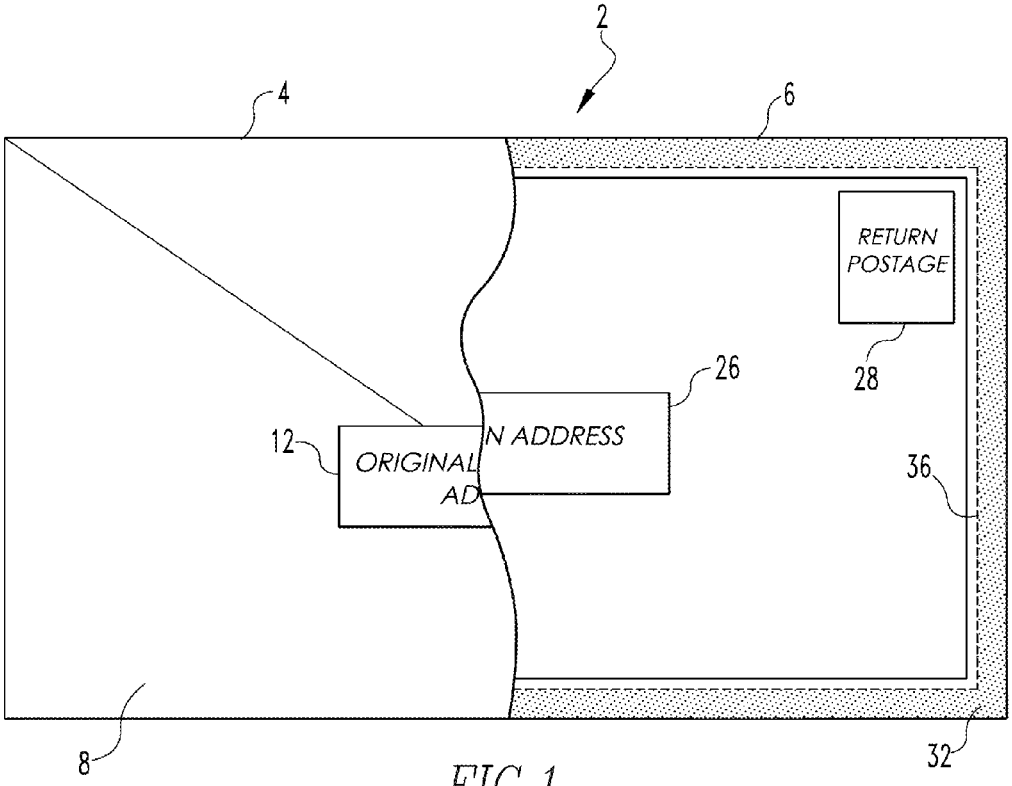
FIG. 1 is a schematic diagram in partial cut-away form of an envelope assembly according to one particular embodiment of the present invention.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As employed, herein, the statement that two or more parts or components are "coupled" together shall mean that the parts are joined or operate together either directly or through one or more intermediate parts or components.

As employed herein, the statement that two or more parts or components "engage" one another shall mean that the parts exert a force against one another either directly or through one or more intermediate parts or components.

As employed herein, the term "number" shall mean one or an integer greater than one (i.e., a plurality).

FIG. 1 is a schematic diagram in partial cut-away form of an envelope assembly 2 according to one particular embodiment of the present invention. As described in greater detail herein, the envelope assembly 2 facilitates mailings wherein the original recipient is expected to provide a return mailing to the original sender by providing in a single assembly both a first mechanism for sending the materials of the original mailing, such as, without limitation, a statement of account and an invoice or a written survey, from an original sender to an original recipient and a second mechanism for sending the corresponding return materials, such as, without limitation, a check or a completed survey, from the original recipient to the original sender. More specifically, the envelope assembly 2 includes an original envelope component 4 for containing the original mailing materials and a return envelope component 6 that is coupled to and selectively separable from the original envelope component 4 for containing the return mailing materials. The construction of the envelope assembly 2 is described in detail below in connection with FIGS. 2-4, wherein FIG. 2 is a front elevational view of the original envelope component 4, FIG. 3 is a rear elevational view of the original envelope component 4, FIG. 4 is a front elevational view of the return envelope component 6, and FIG. 5 is a rear elevational view of the return envelope component 6.

Figure 2:
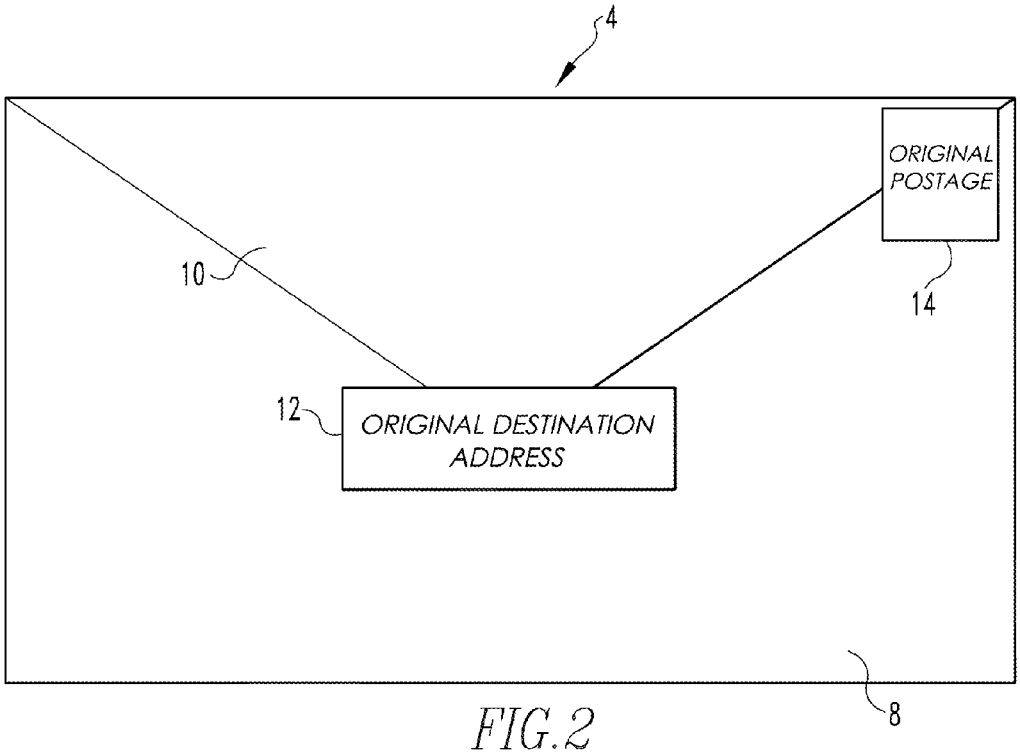
FIG. 2 is a front elevational view of the original envelope component of the envelope assembly of FIG. 1.

Referring to FIG. 2, the original envelope component 4 includes a front side 8 having a flap portion 10 for sealing off an interior portion of the original envelope component 4 in a manner similar to a conventional mailing envelope. In addition, as seen in FIG. 2 (and partially in FIG. 1), the original destination address 12 and the original postage 14 for the original mailing are provided on the front side 8 of the original envelope component 4 after the flap portion 10 is sealed, such as by printing those items on the front side 8 and/or adhering a label including those items on to the front side 8.

Figure 3:
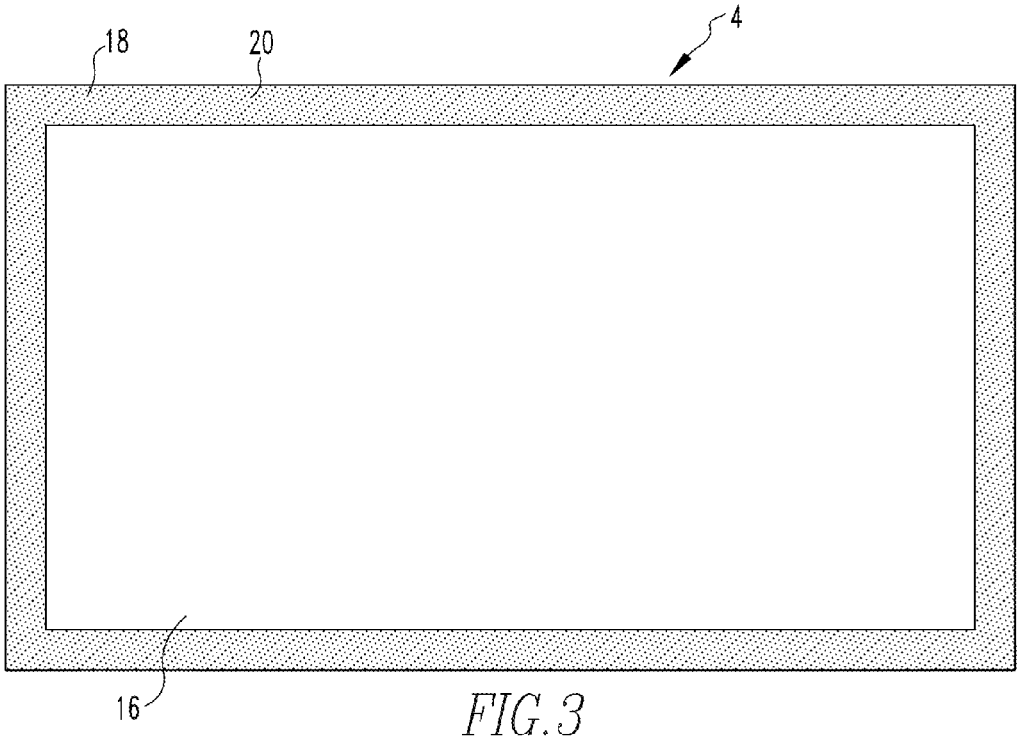
FIG. 3 is a rear elevational view of the original envelope component of the envelope assembly of FIG. 1.

In addition, referring to FIG. 3, the original envelope component 4 includes a rear side 16 having an attachment portion 18, which in the exemplary embodiment is in the form of an attachment border provided around the perimeter of the rear side 16. As described in greater detail herein, the attachment portion 18 of the rear side 16 is the portion of the original envelope component 4 to which the return envelope component 6 is attached by, for example, a suitable adhesive 20.

Figure 4:
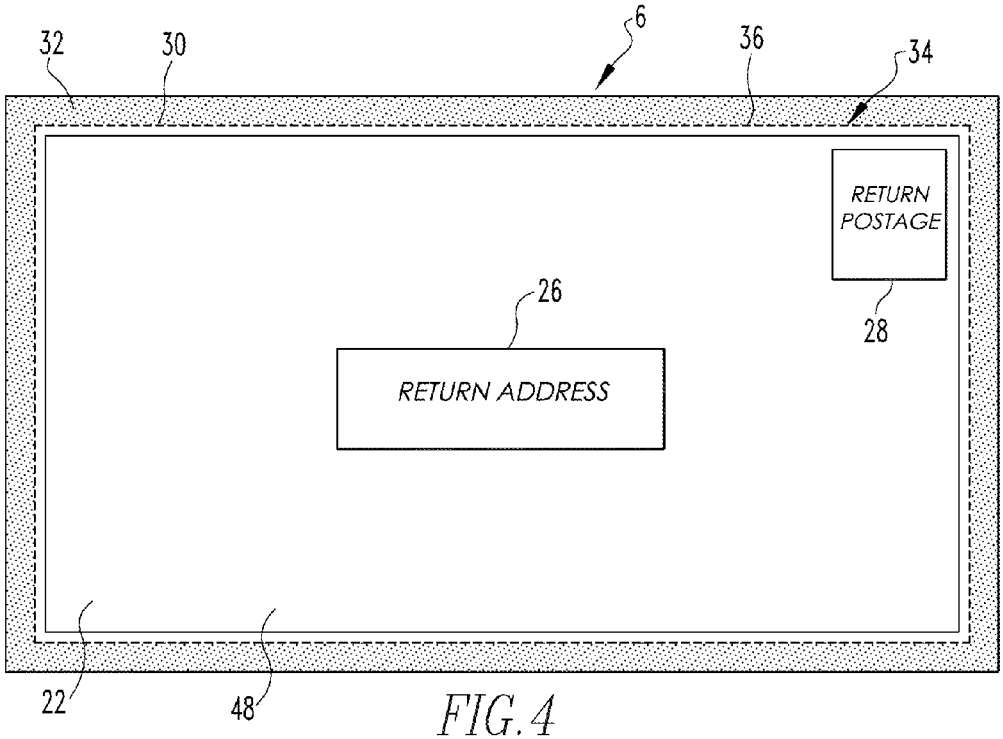
FIG. 4 is a front elevational view of the return envelope component of the envelope assembly of FIG. 1.
Figure 5:
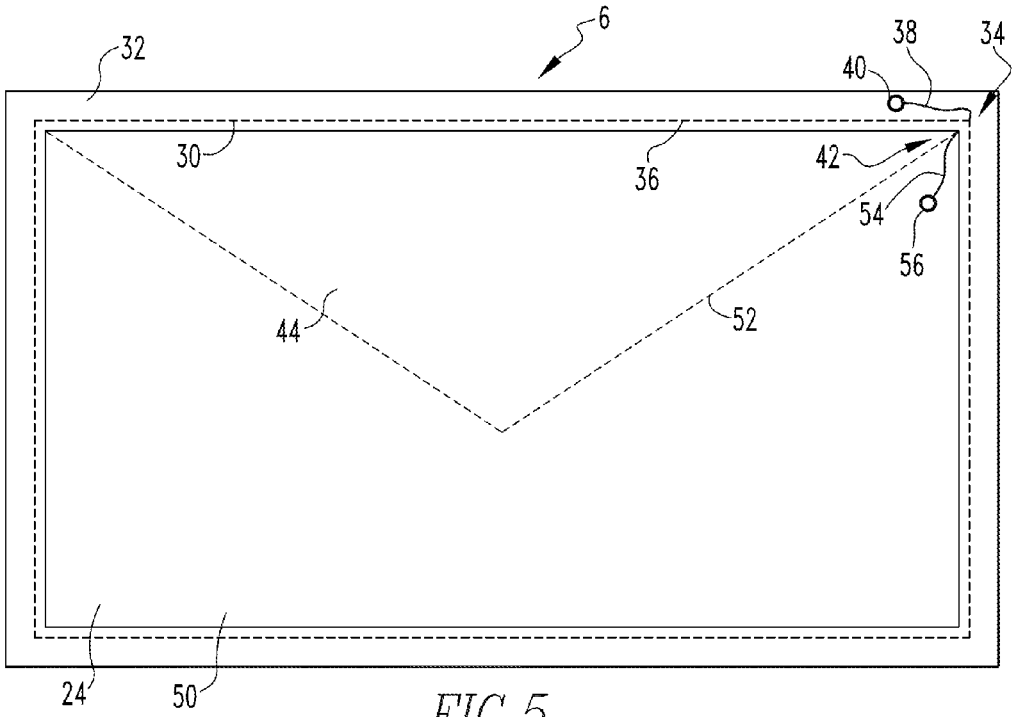
FIG. 5 is a rear elevational view of the return envelope component of the envelope assembly of FIG. 1.
Figure 6:
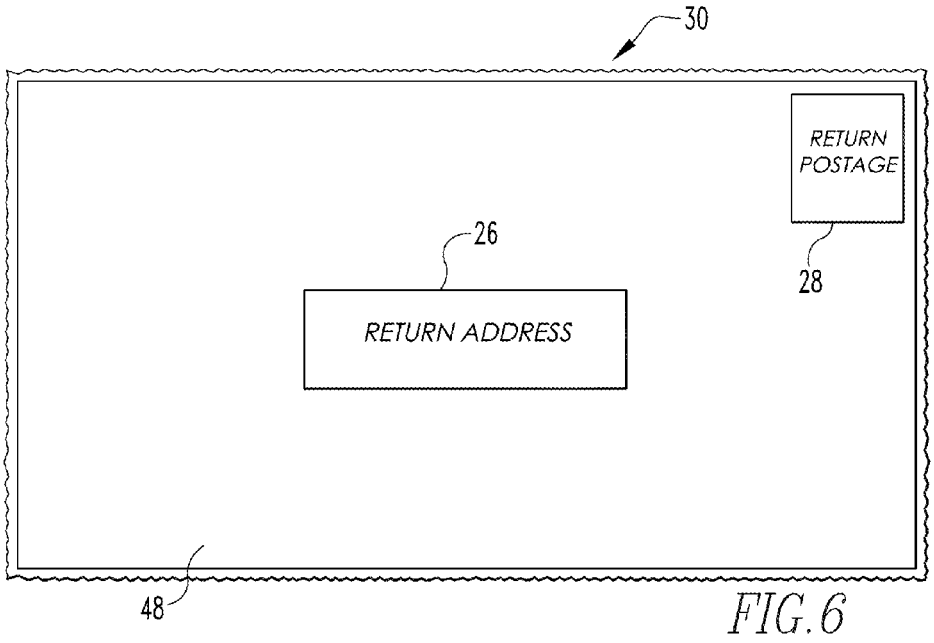
FIG. 6 is a front elevational view of the front side of the return envelope portion of the return envelope component of the envelope assembly of FIG. 1.
Figure 8:
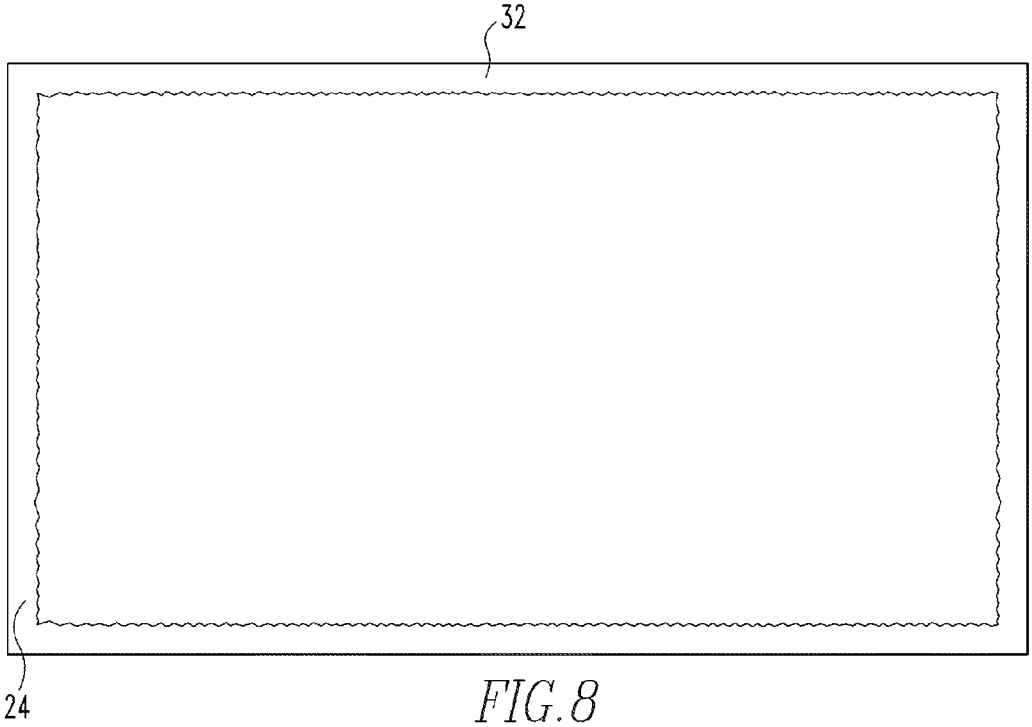
FIG. 8 shows the attachment portion of the return envelope component of FIGS. 4 and 5 after removal of the return envelope portion thereof.

Referring to FIGS. 4 and 5, the return envelope component 6 includes a front side 22 and a rear side 24. The front side 22 of the return envelope component 6 includes a pre-printed return address 26 (i.e., the address to which the return mailing materials are to be sent) and pre-printed/pre-applied return postage 28 provided thereon. In addition, as seen in both FIGS. 4 and 5, the return envelope component 6 also includes a return envelope portion 30 and an attachment portion 32. The return envelope portion 30 is coupled to and selectively separable from the attachment portion 32 by way of a separation device 34 that extends around the entire perimeter of the return envelope portion 30. In the exemplary embodiment shown in FIGS. 1, 4 and 5, the separation device 34 comprises a perforation 36 extending around the entire perimeter of the return envelope portion 30 and a string 38 coupled to a pull tab 40 provided under the perforation 36. In operation, a person may pull on the pull tab 40 to lift the string 38 and cause the perforation 36 to separate around the entire perimeter of the return envelope portion 30. As a result, the return envelope portion 30 will be completely separated from the attachment portion 32 as shown in FIG. 6. As shown in FIG. 8, after the return envelope portion 30 has been separated as described above, only the attachment portion 32 will be left behind.

Figure 7:
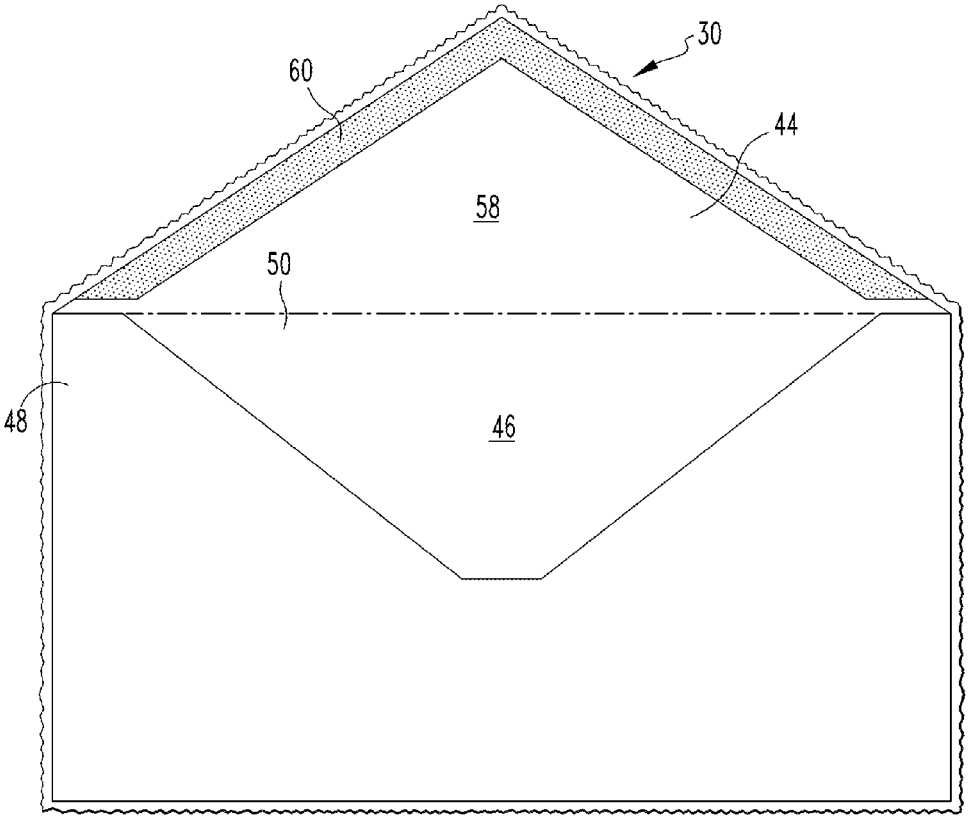
FIG. 7 is a front elevational view of the rear side of the return envelope portion of the return envelope component of the envelope assembly of FIG. 1.

Furthermore, the return envelope portion 30 includes a second separation device 42 for selectively creating a flap portion 44 of the return envelope 30 as shown in FIG. 7 (which, like FIG. 6, shows the return envelope portion 30 completely separated from the attachment portion 32) for sealing off an interior portion 46 provided between a front side 48 and a rear side 50 of the return envelope 30. Thus, as shown in FIGS. 6 and 7, when the return envelope portion 30 is completely separated from the attachment portion 32, the return envelope portion 30 has a form that is similar to a conventional mailing envelope. In the exemplary embodiment shown in FIG. 5, the second separation device 42 comprises a perforation 52 extending in a V-shape along the rear side 50 of the return envelope portion 30 and a string 54 coupled to a pull tab 56 provided under the perforation 52. In operation, a person may pull on the pull tab 56 to lift the string 54 and cause the flap portion 44 to separate from the remainder of the rear side of the return envelope portion 30. The underside 58 of the flap portion 44 is, in the exemplary embodiment, provided with an adhesive 60 for enabling the flap portion 44 to be sealed against the front side 48 after the return mailing materials have been inserted into the interior 46.

Having described the various component parts of the envelope assembly 2 above, the construction and operation of the envelope assembly 2 as a whole will now be described. To construct the envelope assembly 2, the original envelope component 4 is attached to the return envelope component 6 by joining attachment portion 18 of the original envelope component 4 to the attachment portion 32 of the return envelope component 6 using the adhesive 20. As will be appreciated, when this is done, the rear side 16 of the original envelope component 4 will face the front side 22 of the return envelope component 6 as shown in FIG. 1. The original mailing materials may then be inserted into the interior of the original envelope component 4 and the flap portion 10 of the original envelope component 4 may be closed and sealed. Then, the original address 12 and the original postage 14 may be applied to the original envelope component 4 and the envelope assembly 2 may be mailed to the original recipient.

Upon receiving the envelope assembly 2, the original recipient may open the flap portion 10 and remove the original mailing materials. The original recipient may remove the return envelope portion 30 from the envelope assembly 2 using the separation device 34 as described elsewhere herein (see FIG. 6). The original recipient may also then create the flap portion 44 using the separation device 42 as described elsewhere herein (see FIG. 7). When the return mailing materials are ready to be sent, the original recipient may insert them into the interior 46 of the return envelope portion 30 and close and seal the flap portion 44. The return envelope portion 30 may then be deposited into the mail to be sent to the return address 26 using the return postage 28.

Thus, the present invention as described in connection with exemplary embodiments provided herein advantageously facilitates mailings wherein the original recipient is expected to provide a return mailing to a specific return address original sender by providing both a first mechanism for sending the materials of the original mailing and a second mechanism for sending the corresponding return materials in an easy to use single integrated envelope assembly.

Figure 9:
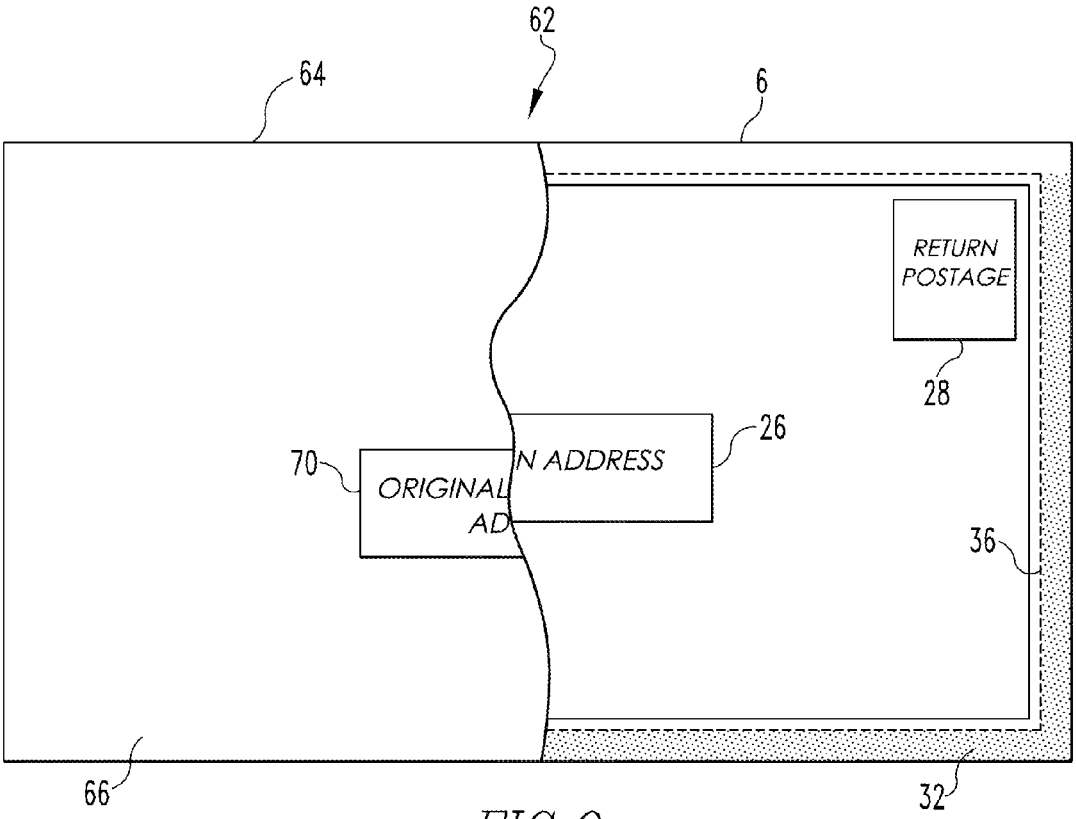
FIG. 9 is a schematic diagram in partial cut-away form of an envelope assembly according to one alternative embodiment of the present invention.
Figure 10:
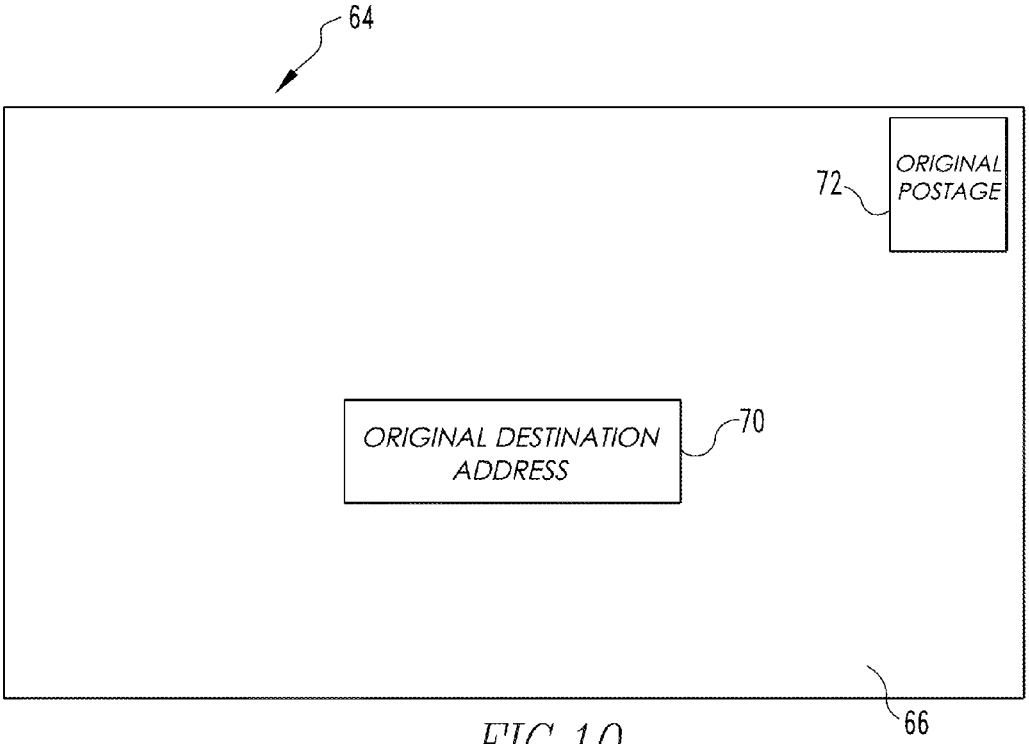
FIG. 10 is a front elevational view of an original address portion of the envelope assembly of FIG. 9.

FIG. 9 is a schematic diagram in partial cut-away form of an envelope assembly 62 according to one alternative embodiment of the present invention. Envelope assembly 62 includes an original address portion 64 that is coupled to a return envelope component 6 that is similar to the return envelope component 6 that is described elsewhere herein in connection with FIGS. 1 and 4-8 (thus, like components are labeled in FIG. 9 with like reference numerals). FIG. 10 is a front elevational view and FIG. 11 is a rear elevational view of the original address portion 64 of the envelope assembly of FIG. 9.

Figure 11:
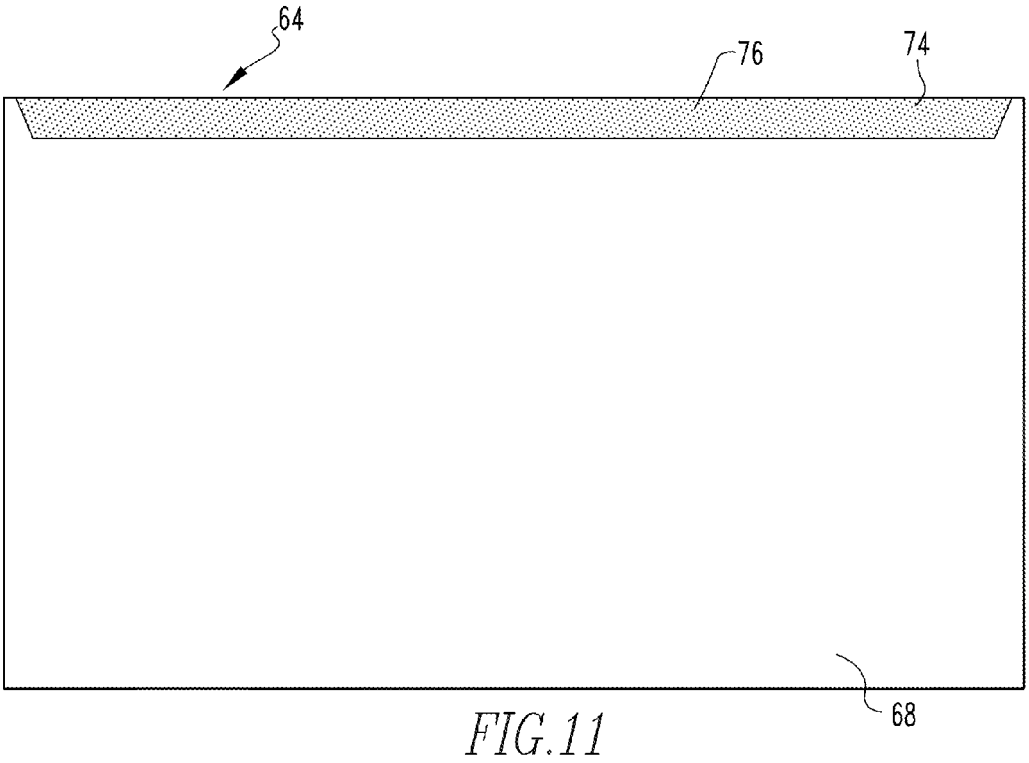
FIG. 11 is a rear elevational view of the original address portion of the envelope assembly of FIG. 9.

As seen in FIGS. 10 and 11, original address portion 64 comprises a flat sheet having a front side 66 and a rear side 68. The original destination address 70 and the original postage 72 for the original mailing (sent in the form of envelope assembly 62) are, prior to mailing, provided on the front side 66 of the original address portion 64, such as by printing those items on the front side 66 and/or adhering a label including those items on to the front side 66. The top edge of the rear side 68 of original address portion 64 is provided with a sealing portion 74 having a suitable adhesive 76 provided thereon. The purpose of sealing portion 74 is described below.

As seen in FIG. 9, and as described elsewhere herein, return envelope component 6 includes an attachment portion 32. When envelope assembly 62 is constructed, original address portion 64 is coupled to return envelope component 6 by attaching the left, right and bottom outer edges of the rear side 68 of original address portion 64 to attachment portion 32 using a suitable adhesive. When this is done, an interior pocket is formed within envelope assembly 64 (between return envelope component 6 and original address portion 64). The original mailing materials may then be inserted into the interior pocket, the original address 70 and the original postage 72 may be applied to the original address portion 64, the envelope assembly 64 may be closed by causing the sealing portion 74 of the original address portion 64 to be attached to the top edge of return envelope component 6 using the adhesive 76, and the envelope assembly 62 may be mailed to the original recipient.

Upon receiving the envelope assembly 62, the original recipient may open the top edge thereof by separating the sealing portion 74 from the top edge of return envelope component 6 and remove the original mailing materials. The original recipient may remove the return envelope portion 30 from the envelope assembly 62 using the separation device 34 as described elsewhere herein (see FIG. 6). The original recipient may also then create the flap portion 44 using the separation device 42 of return envelope portion 30 as described elsewhere herein (see FIG. 7). When the return mailing materials are ready to be sent, the original recipient may insert them into the interior 46 of the return envelope portion 30 and close and seal the flap portion 44. The return envelope portion 30 may then be deposited into the mail to be sent to the return address 26 using the return postage 28.

Figure 12:
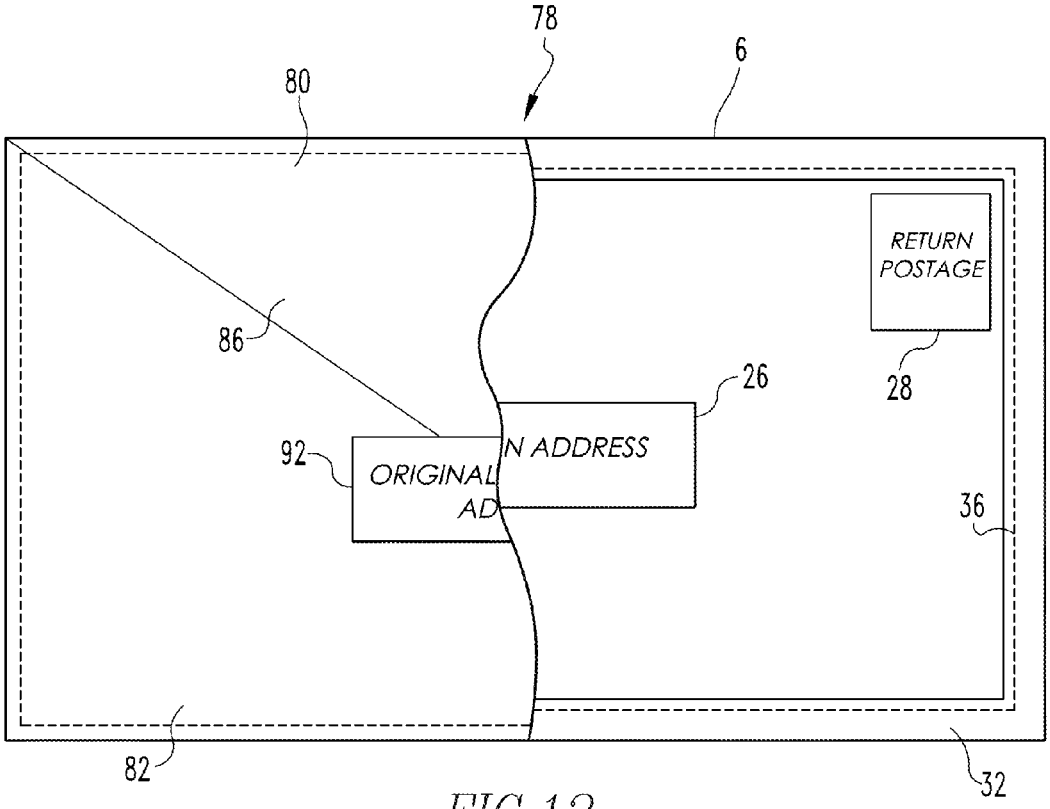
FIG. 12 is a schematic diagram in partial cut-away form of an envelope assembly according to another alternative embodiment of the present invention.
Figure 13:
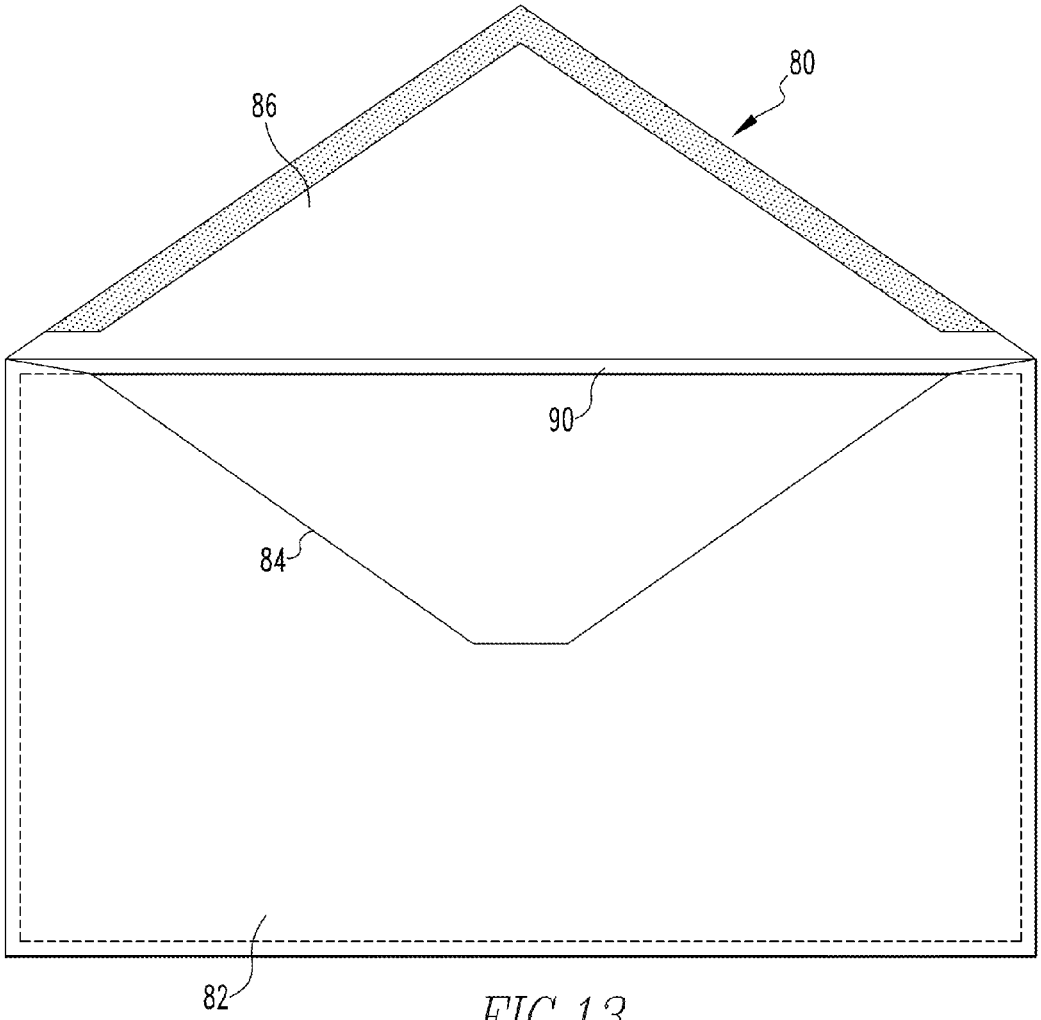
FIG. 13 is a front elevational view of an original address portion of the envelope assembly of FIG. 12.

FIG. 12 is a schematic diagram in partial cut-away form of an envelope assembly 78 according to another alternative embodiment of the present invention. Envelope assembly 78 includes an original address portion 80 that is coupled to a return envelope component 6 that is similar to the return envelope component 6 that is described elsewhere herein in connection with FIGS. 1 and 4-9 (thus, like components are labeled in FIG. 12 with like reference numerals). FIG. 13 is a front elevational view and FIG. 14 is a rear elevational view of the original address portion 80 of the envelope assembly of FIG. 12.

Figure 14:
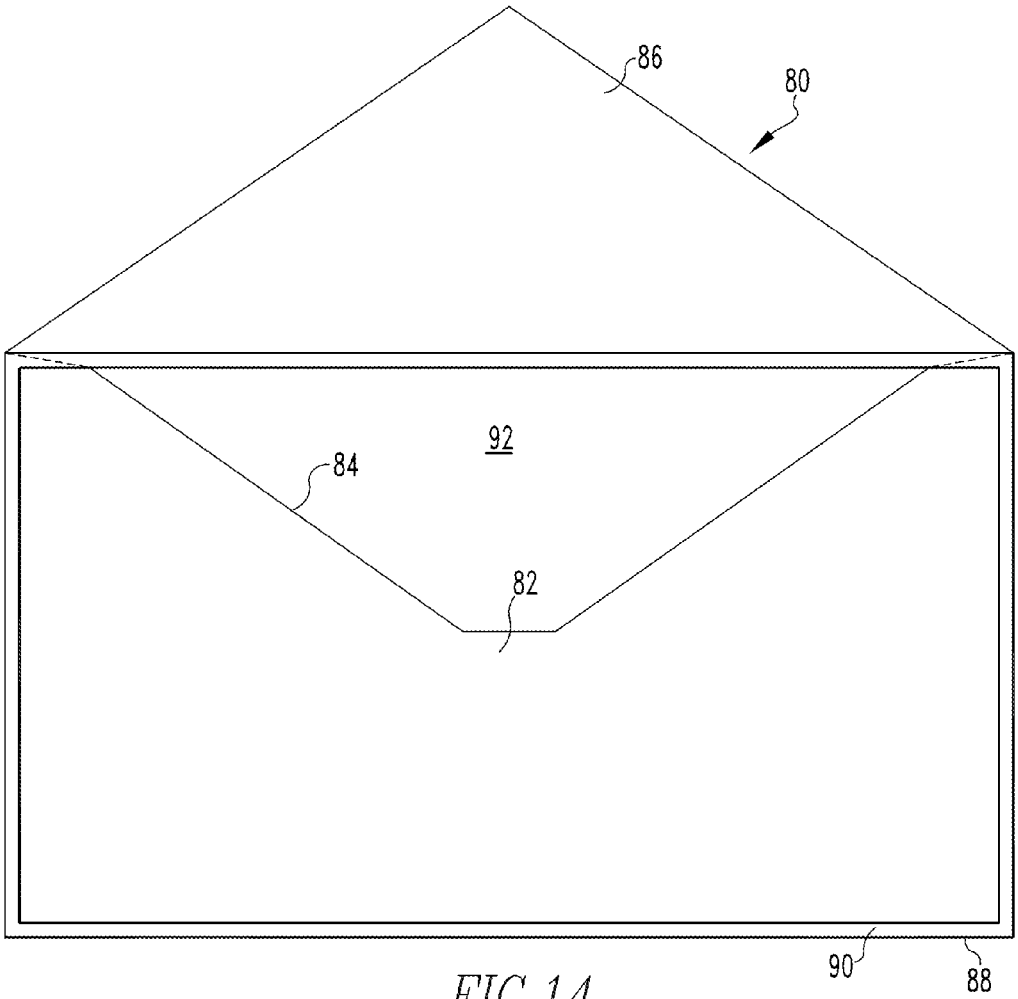
FIG. 14 is a rear elevational view of the original address portion of the envelope assembly of FIG. 12.

As seen in FIGS. 13 and 14, original address portion 80 in the present embodiment resembles a traditional mailing envelope and thus includes a front side 82 having a downwardly extending top edge 84. Original address portion 80 also includes a flap portion 86 attached to a rear side 88 (FIG. 14) of original address portion 80. As seen in FIGS. 13 and 14, rear side 88 comprises a rectangular border portion 90 defining a rectangular opening 92.

As seen in FIG. 12, and as described elsewhere herein, return envelope component 6 includes an attachment portion 32. When envelope assembly 78 is constructed, original address portion 80 is coupled to return envelope component 6 by attaching the border portion 90 of original address portion 80 to attachment portion 32 using a suitable adhesive. When this is done, an interior pocket is formed within envelope assembly 78 (between return envelope component 6 and front side 82 of original address portion 80). The original mailing materials may then be inserted into the interior pocket, the flap portion 86 may be folded down and sealed to front side 82, the original address 92 and the original postage (not shown) may be applied to the front side 82 of original address portion 80, and the envelope assembly 78 may be mailed to the original recipient.

Upon receiving the envelope assembly 78, the original recipient may open it by separating the flap portion 86 from the front side 82, and may remove the original mailing materials. The original recipient may remove the return envelope portion 30 from the envelope assembly 78 using the separation device 34 as described elsewhere herein (see FIG. 6). The original recipient may also then create the flap portion 44 using the separation device 42 of return envelope portion 30 as described elsewhere herein (see FIG. 7). When the return mailing materials are ready to be sent, the original recipient may insert them into the interior 46 of the return envelope portion 30 and close and seal the flap portion 44. The return envelope portion 30 may then be deposited into the mail to be sent to the return address 26 using the return postage 28.

Figure 15:
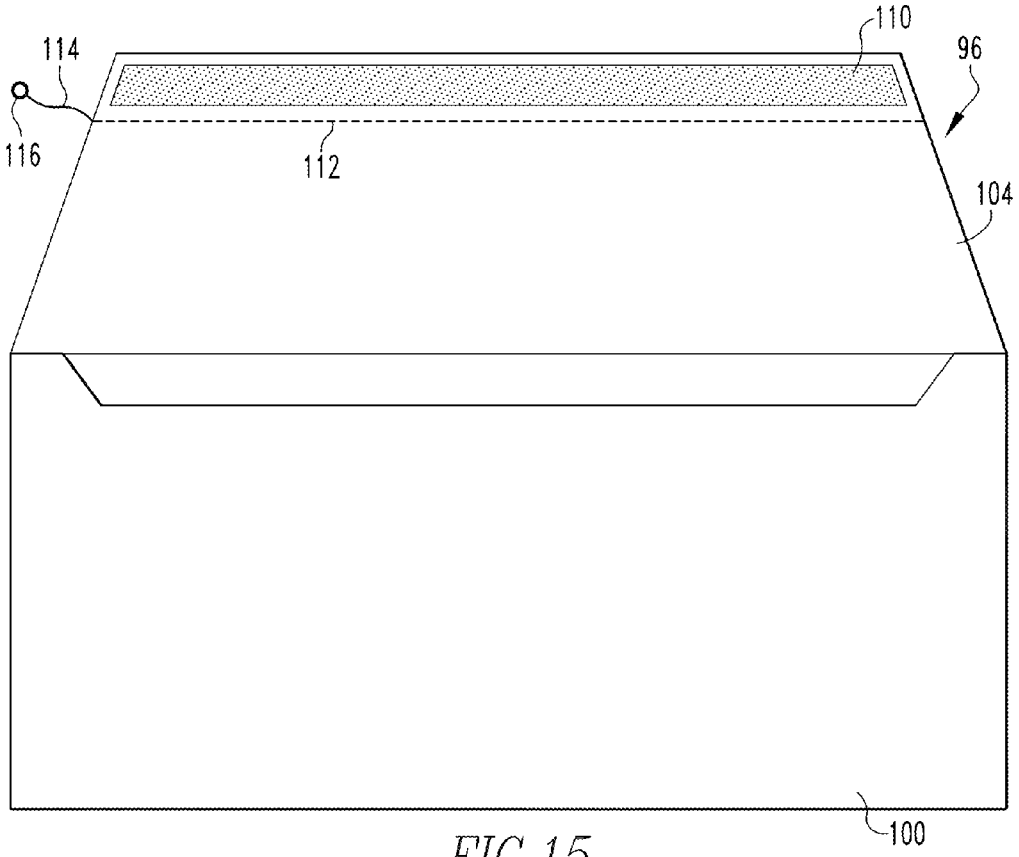
FIGS. 15 and 16 are front and rear elevational views, respectively, of an original envelope component of the envelope assembly shown in FIG. 19.
Figure 16:
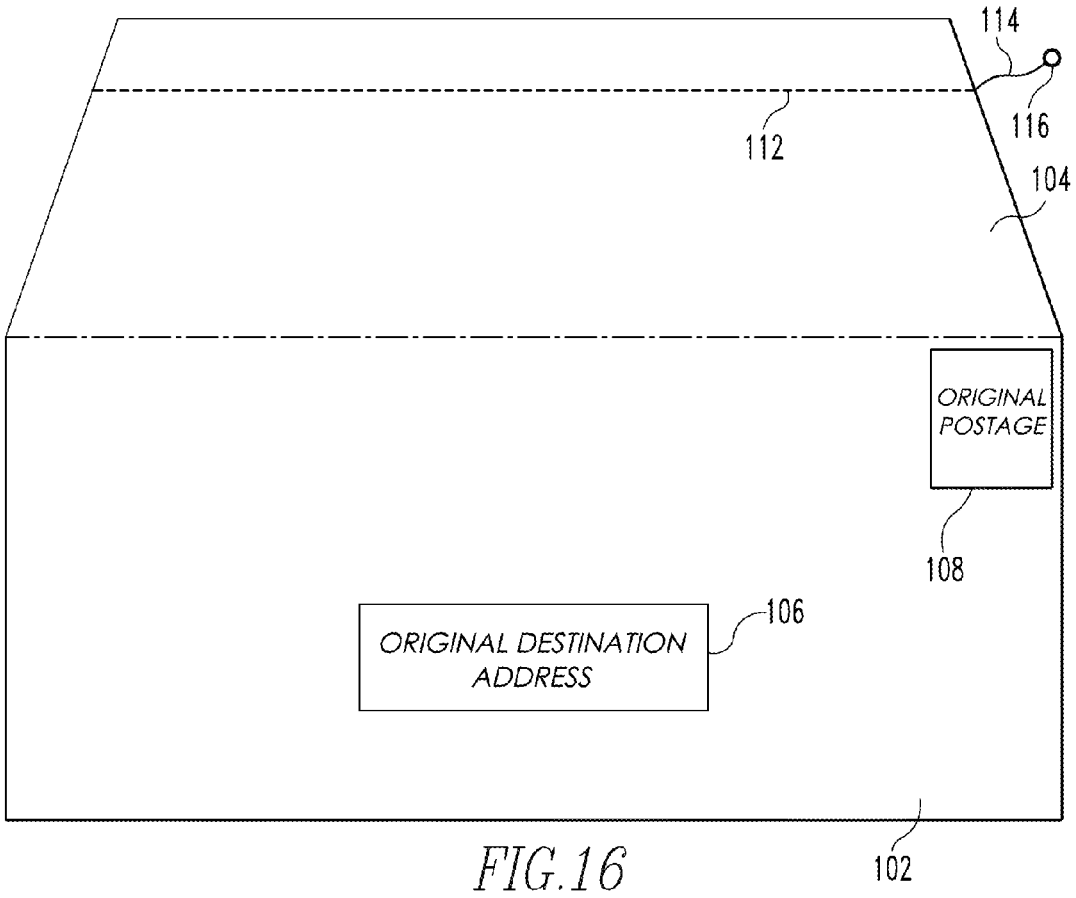
Figure 17:
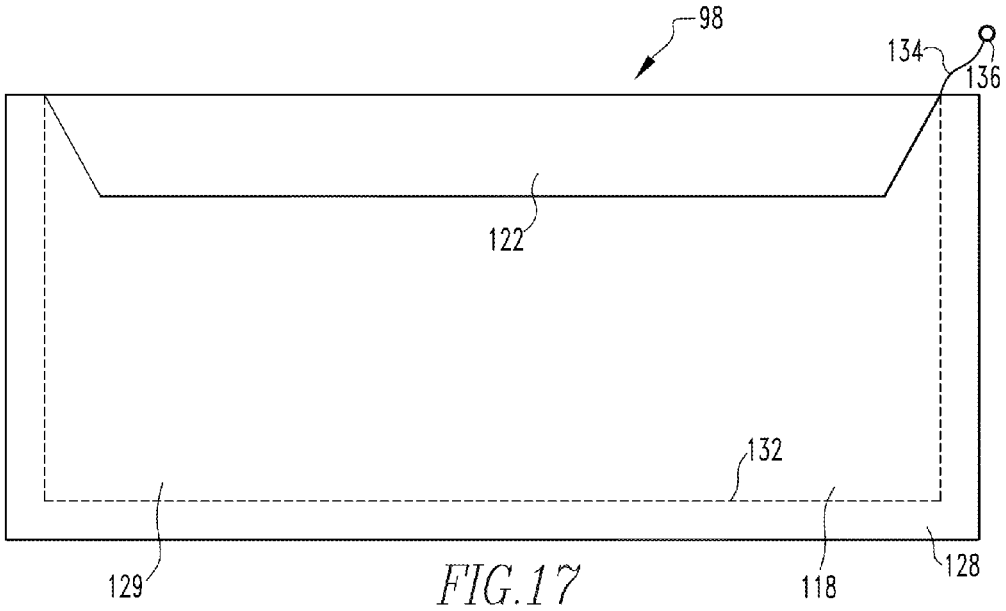
FIGS. 17 and 18 are front and rear elevational views, respectively, of a return envelope component of the envelope assembly shown in FIG. 19.
Figure 18:
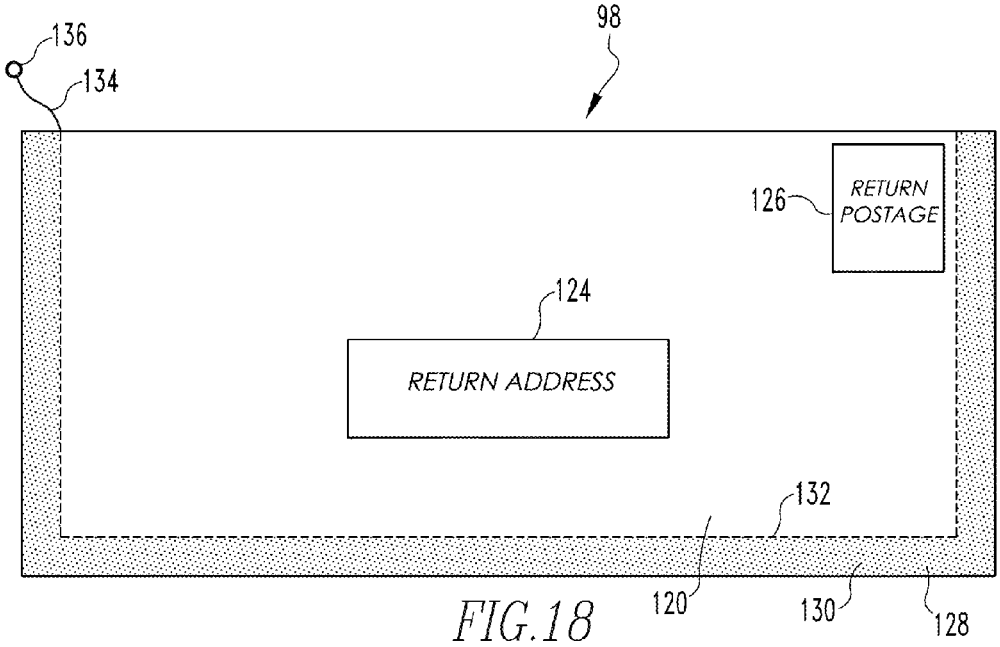
Figure 19:
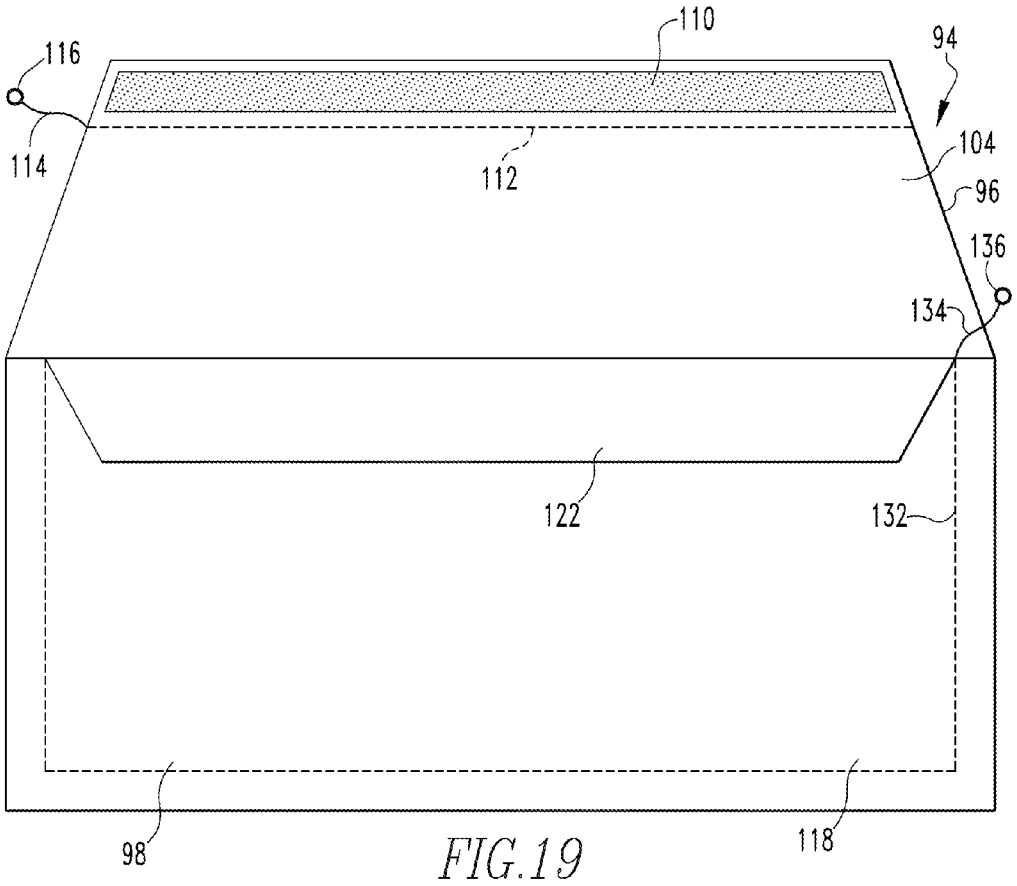
FIG. 19 is a front elevation view of an envelope assembly according to another alternative embodiment of the present invention.

FIGS. 15-19 depict the components of an envelope assembly 94 according to another alternative embodiment. In particular, FIGS. 15 and 16 are front and rear elevational views, respectively, of an original envelope component 96 of the envelope assembly 94, FIGS. 17 and 18 are front and rear elevational views, respectively, of a return envelope component 98 of the envelope assembly 94, and FIG. 19 is a front elevation view of the fully assembled envelope assembly 94.

Referring to FIGS. 15 and 16, original envelope component 96 is similar to a conventional mailing envelope and includes front side 100, rear side 102, and flap 104 attached to rear side 102 and structured to fold down over front side 100. As seen in FIG. 16, the original destination address 106 and the original postage 108 for the original mailing are provided on rear side 102. Also, flap 104 includes adhesive portion 110, perforation 112 and string 114 having pull tab 116 attached thereto. The function of these items is described in greater detail below.

Referring to FIGS. 17 and 18, return envelope component 98 includes front side 118, rear side 120, and flap 122 attached to rear side 120 and structured to fold down over front side 118. As seen in FIG. 18, the return address 124 and return postage 126 are provided on rear side 120. In addition, return envelope component 98 includes attachment portion 128 extending on the left, right and bottom edges thereof and a return envelope portion 129 (similar to return envelope portion 30 described elsewhere herein). An adhesive 130 is provided on attachment portion 128 on rear side 120. A perforation 132 is provided along attachment portion 128, and string 134 having pull tab 116 attached thereto are provided for separating perforation 132. When the perforation 132 is separated, the return envelope portion 129 will be completely separated from the attachment portion 128. The function of each of these items is described in greater detail below.

Referring to FIG. 19, when constructed, return envelope component 98 is attached to front side 100 of original envelope component 96. More specifically, return envelope component 98 is attached to front side 100 of original envelope component 96 by attaching attachment portion 128 to the front side 100 using the adhesive 130. In this configuration, the rear side 120 of return envelope component 98 faces the front side 100 of original envelope component 96. The original mailing materials may then be inserted into the interior pocket of original envelope component 96 (formed between the front side 100 and the rear side 102 thereof), the flap 104 may be folded down over flap 122 and sealed to front side 118 of return envelope component 98, the original address 106 and the original postage 108 may be applied to the front side 102 of original envelope component 96, and the envelope assembly 94 may be mailed to the original recipient.

Upon receiving the envelope assembly 94, the original recipient may open it by separating the flap 104 from the front side 118 of return envelope component 98 by separating perforation 112 using string 114 and pull tab 116, and may remove the original mailing materials. The original recipient may then remove the return envelope portion 129 from the envelope assembly 94 by separating perforation 132 using string 134 and pull tab 136 (the attachment portion 128 will be left behind). When the return mailing materials are ready to be sent, the original recipient may insert them into the interior of the return envelope portion 129 and close and seal the flap 122. The return envelope portion 129 may then be deposited into the mail to be sent to the return address 124 using the return postage 126.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An envelope assembly, comprising:

an original envelope component having a rear side having an original destination address provided thereon, a front side opposite the rear side of the original envelope component having a first edge, a second edge opposite the first edge, and a third edge transverse to the first edge and the second edge, a first attachment portion including the first edge, the second edge and the third edge, a first interior for receiving original mailing materials, and a flap attached to the rear side of the original envelope component; and a return envelope component having a fourth edge, a fifth edge opposite the fourth edge, and a sixth edge transverse to the fourth edge and the fifth edge, the return envelope component including a second attachment portion including the fourth edge, the fifth edge and the sixth edge and a return envelope portion, the second attachment portion of the return envelope component being attached to the first attachment portion of the original envelope component in an overlapping fashion such that the first and fourth edges are attached to one another, the second and fifth edges are attached to one another, and the third and sixth edges are attached to one another, the return envelope portion having a rear side having a return address provided thereon, a front side opposite the rear side of the return envelope portion, and a second interior for receiving return mailing materials, the flap being structured to fold down over and be removeably attached to the front side of the return envelope portion by a first separation device, and the return envelope portion being removeably attached to and selectively separable from the second attachment portion by a second separation device in a manner wherein when the return envelope portion is separated from the second attachment portion the second attachment portion remains attached to the first attachment portion such that the first and fourth edges are attached to one another, the second and fifth edges are attached to one another, and the third and sixth edges are attached to one another.

* * * * *